US007253349B1

(12) United States Patent
Saltsman

(10) Patent No.: US 7,253,349 B1
(45) Date of Patent: Aug. 7, 2007

(54) ENGINEERS PIANO WITH BISYMMETRICAL MANUALS AND ACCOMPANYING MUSICAL NOTATION SYSTEM

(76) Inventor: Joseph Clay Saltsman, 1671 Vt Rt 111, Derby, VT (US) 05829

( * ) Notice: Subject to any disclaimer, the term of this patent is extended or adjusted under 35 U.S.C. 154(b) by 0 days.

(21) Appl. No.: 11/423,999

(22) Filed: Jun. 14, 2006

(51) Int. Cl.
*G10C 3/12* (2006.01)

(52) U.S. Cl. ..... 84/424; 84/423 R; 84/425; 84/428; 84/432; 84/718; 84/719; 84/720; 84/477 R; 84/478; 84/743; 84/744; 84/745; 84/483.1; 84/483.2

(58) Field of Classification Search ..... 84/423 R, 84/424, 425, 427, 428, 432, 718–720, 743–745, 84/477 R, 478, 483.1, 483.2
See application file for complete search history.

(56) References Cited

U.S. PATENT DOCUMENTS

| | | | | | |
|---|---|---|---|---|---|
| 152,726 | A * | 7/1874 | Cramer | 84/428 |
| 334,484 | A * | 1/1886 | Stewart | 84/428 |
| 2,406,946 | A * | 9/1946 | Firestone | 84/423 R |
| 2,761,344 | A * | 9/1956 | Koehl | 84/171 |
| 3,757,024 | A * | 9/1973 | Stinson et al. | 84/716 |
| 3,865,004 | A * | 2/1975 | Coles | 84/423 R |
| 3,941,023 | A * | 3/1976 | Thomas et al. | 84/715 |
| 3,943,811 | A * | 3/1976 | Coles | 84/678 |
| 3,973,460 | A * | 8/1976 | Coles | 84/678 |
| 3,986,422 | A * | 10/1976 | Coles | 84/678 |
| 4,054,079 | A * | 10/1977 | Sohler | 84/423 R |
| 4,123,960 | A * | 11/1978 | Franzmann | 84/644 |
| 4,277,090 | A * | 7/1981 | Lusi | 84/483.2 |
| 4,640,173 | A * | 2/1987 | Coles | 84/657 |
| 5,404,788 | A * | 4/1995 | Frix | 84/423 R |
| 5,574,238 | A * | 11/1996 | Mencher | 84/483.2 |
| 6,194,646 | B1 * | 2/2001 | Kowalski | 84/423 R |
| 6,218,601 | B1 * | 4/2001 | Pientka | 84/423 R |
| 6,444,888 | B1 * | 9/2002 | VanDruff | 84/609 |
| 6,566,593 | B2 * | 5/2003 | Pertchik | 84/423 R |
| 2002/0029682 | A1 * | 3/2002 | Pertchik | 84/477 R |

OTHER PUBLICATIONS

Seed, Christopher, www.lefthandedpiano.co.uk "The First Left-Handed Piano," citations from the London Times Mar. 11, 1997; also page /midi.html, Make your keyboard right for you by making it left-handed, Keyboard Mirror.*

(Continued)

*Primary Examiner*—Lincoln Donovan
*Assistant Examiner*—Robert W. Horn
(74) *Attorney, Agent, or Firm*—Jay R. Yablon

(57) ABSTRACT

A 2 manual musical keyboard with the pitch progression on one of the manuals reversed. The keys on these manuals are segregated into 2 groups of 2 different heights in the same way as a standard musical keyboard. The key configurations on these manuals have 12 semi-tones linearly distributed across 12 keys of alternating heights. Instead of the traditional 7 lower keys (white) and 5 upper keys (black), this arrangement has 6 lower keys and 6 upper keys. The notation system for this unique keyboard is a dual character set. Six unique characters for the upper keys and six unique characters for the lower keys. The musical staff for this unique keyboard will have six lines assigned to one character set and the six spaces assigned to the other character set.

15 Claims, 3 Drawing Sheets

OTHER PUBLICATIONS

BBC News, A Piano that's right for lefties, Sep. 29, 1998 at http://news.bbc.co.uk/2/hi/uk_news/178608.stm B.*

Birkett, Stephen, Mirror-image Piano, Mechanical Music Digest Arhives, Dec. 1997. at //mmd.foxtail.com/Archives/Digests/199212/1997.12.19.08.html.*

InstrumentZone—Keyboard >> Piano, Keyboard General and Left handed piano at instrumentzone.com/repositoryID14/jump=navbar.*

* cited by examiner

ENGINEERS PIANO WITH BISYMMETRICAL MANUALS AND ACCOMPANYING MUSICAL NOTATION SYSTEM

BACKGROUND OF THE INVENTION

1. Field of the Invention

The present invention relates to a musical keyboard used for composition and performance. More specifically, the present invention relates to a 2-manual, split keyboard (bisymmetrical) and it's accompanying musical notation system.

2. Prior Art

As an engineer, I found the modern piano keyboard and musical notation system needlessly confusing. The myriad number of sharps, flats, key signatures and scale fingerings are much more complex and cumbersome than is necessary. The reason for the system that we presently have was the result of the evolution of musical tastes over the years. At the time when orchestral music was developing, the notes from the major scale were the only acceptable tones that were used in musical composition. In fact, the use of notes not in the major scale was considered in bad taste and almost scandalous. When the harpsichord was first produced, the keyboard consisted of only white keys that were arranged for the major scale . . . there were no black keys. Even though the white keys had been evenly spaced apart, the tones were not. The tone intervals between most of the white keys in this keyboard predecessor are whole tones but 2 of the intervals are half-tones. As music progressed, the rest of the half tones were added to the keyboard in the form of black keys. The result is the keyboard configuration that we presently have.

SUMMARY OF INVENTION

The principal characteristic of the present invention is to provide a musical device and notation system that is far simpler and easier to understand than the musical system that is presently employed.

The novel object of my invention is to divide the standard keyboard into 2 manuals and reverse the direction of the pitch on one of the halves. These bisymmetrical manuals would enable the scale fingering with the left and right hands to be symmetrically the same.

Another object of my invention is to reorganize the black and white key structure of the standard keyboard to be six black keys and six white keys. This will result in a group of 12 semi-tones whose frequencies are found in the 12 keys of the standard keyboard octave. However, the "octave" in a standard keyboard will be called a hexatone in my configuration. One or more reference keys in each manual will be different in sight or touch. This key arrangement is similar to Cramer's U.S. Pat. No. 152,726. However, his patent claims in column 2 lines 41-42 black and white keys "with a scale of figures or letters." This indicates a uniform scale of all figures or all numbers but not both. My notation system will use two simultaneous scale systems. In FIG. 2, one can see the unique simultaneous, dual scale system's progression.

It is also an object of my invention to provide 2 possible staff notation systems that are simpler than the standard staff notation system. These 2 possible staff notation systems also compliment my new keyboard design very efficiently. One of the staff systems will have a vertical structure similar to Johnson U.S. Pat. No. 5,962,800. The other staff system will have a traditional type of horizontal structure. However, both notations will use a unique dual character set for key identification.

BRIEF DESCRIPTION OF THE DRAWINGS

FIG. 2 shows a notation configuration using the traditional left to right notation with dual key character sets. FIG. 3 shows a possible vertical notation system using dual key character sets. FIG. 3 also has an inverted bass clef that would correspond directly to the inverted left hand manual contained in FIG. 1

DETAILED DESCRIPTION

The foregoing objectives can be accomplished by providing a redesigned keyboard split into two manuals. One of these two manuals will have standard pitch progression that has increasing pitches going from left to right. The other manual has decreasing pitches going from left to right. These two manuals may have their first key at any pitch, may have any number of keys of any kind, and may have their spatial location anywhere with respect to each other. Also, the keys in the manuals will be 2 different heights as in a standard keyboard. The keys colored white in FIG. 1 will be lower in height than the keys colored black in FIG. 1. The 12 semi-tones of each hexatone will be linearly distributed among the alternating keys of different heights.

Figure 1:
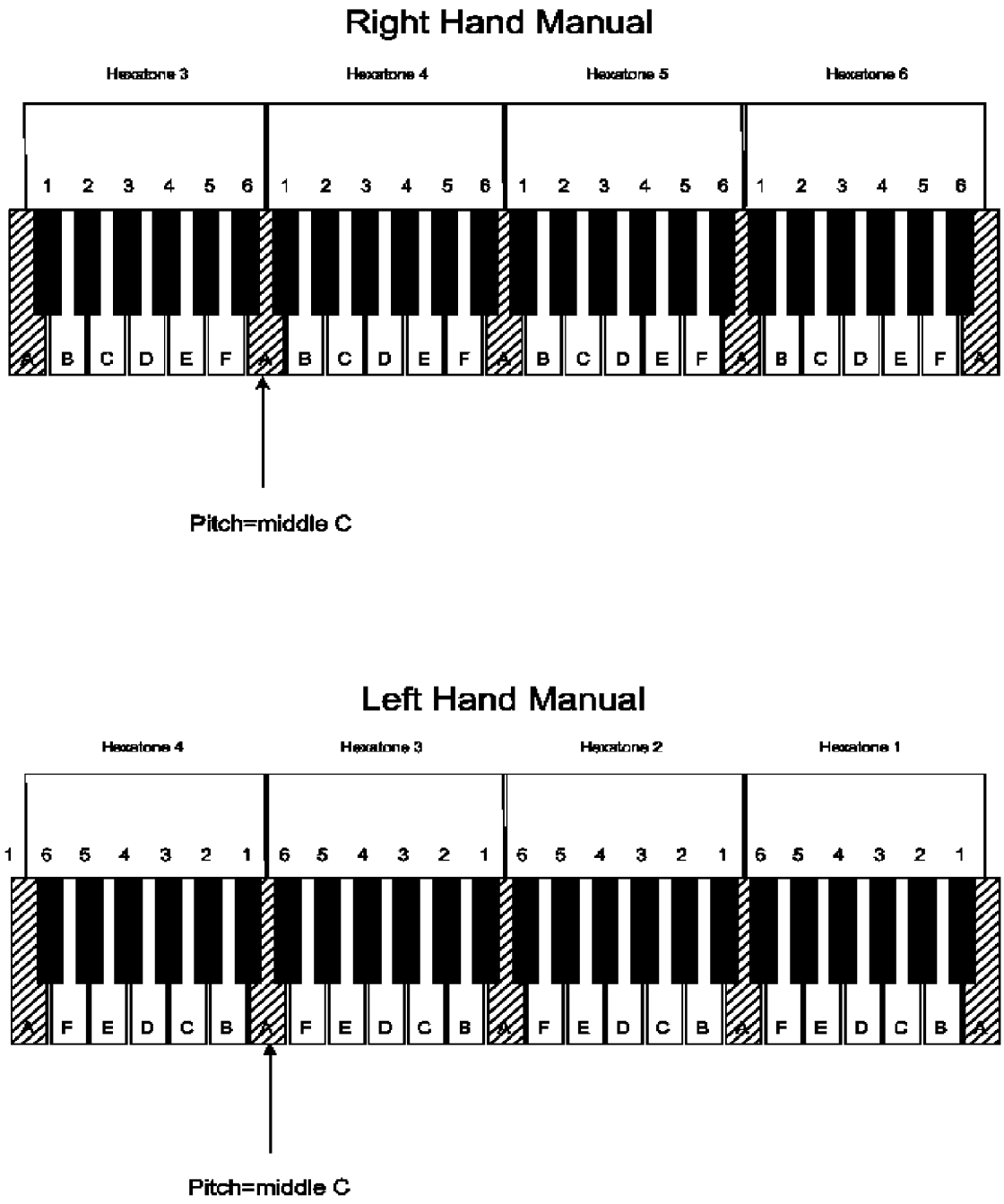
FIG. 1 is a view of one possible configuration of a keyboard arrangement using bisymmetrical manuals and a dual character set. In this demonstration configuration, each "A" key is physically different in sight or touch so as to act as a reference for the beginning of each hexatone.

For demonstration purposes, one possible configuration comprises 4 sets of hexatones for the right hand and 4 sets of hexatones for the left hand as shown in FIG. 1. The right-handed keyboard could have pitches increasing from left to right and the left-handed keyboard could have pitches increasing from right to left. The equivalent of middle C could be located one hexatone in from the left end of the right-handed keyboard and the left-handed keyboard. Also, at least one of the lower keys colored white in FIG. 1, will be physically different in sight or touch so as to act as a location reference. In my demonstration, these reference keys will be each "A" key in each hexatone. A unique dual notation system to be used with this keyboard design is a dual character set that distinguishes the black keys from the white keys. For example, the white set of keys could be identified with the character set A,B,C,D,E, and F while the black set of keys could be identified with the character set 1,2,3,4,5 and 6. The note "C" in the standard keyboard is fundamentally basic to all of the western music today. Because this pitch is so critical to our music, this sample dual character set will assign the character "A" to the frequency pitch of "C."

Figure 2:
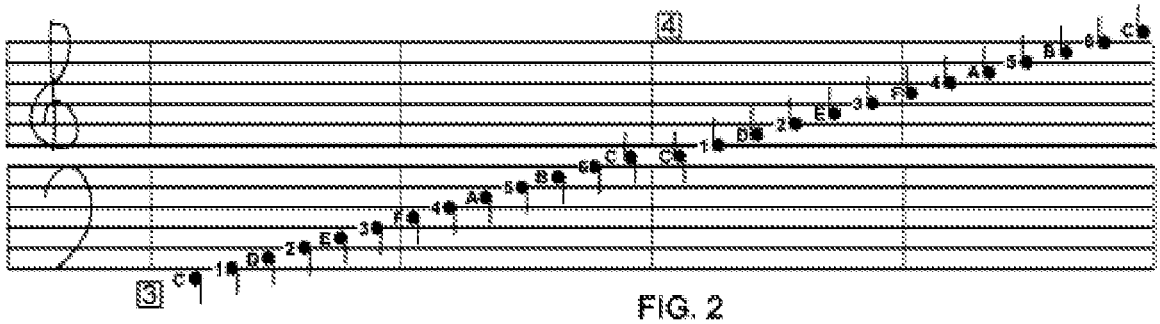
FIG. 2 and FIG. 3 are two possible notation configurations using a bisymmetrical manual keyboard.
Figure 3:
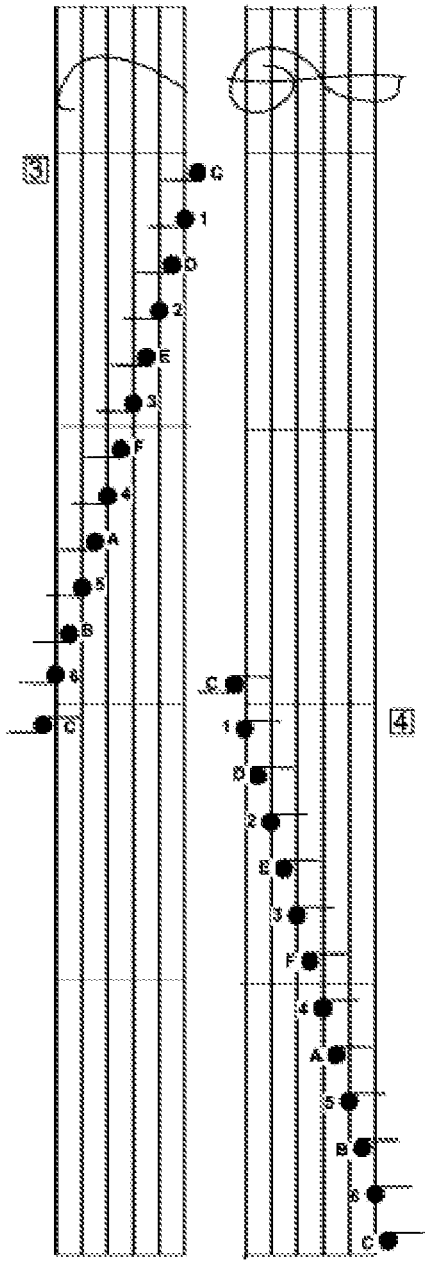
Figure 4:
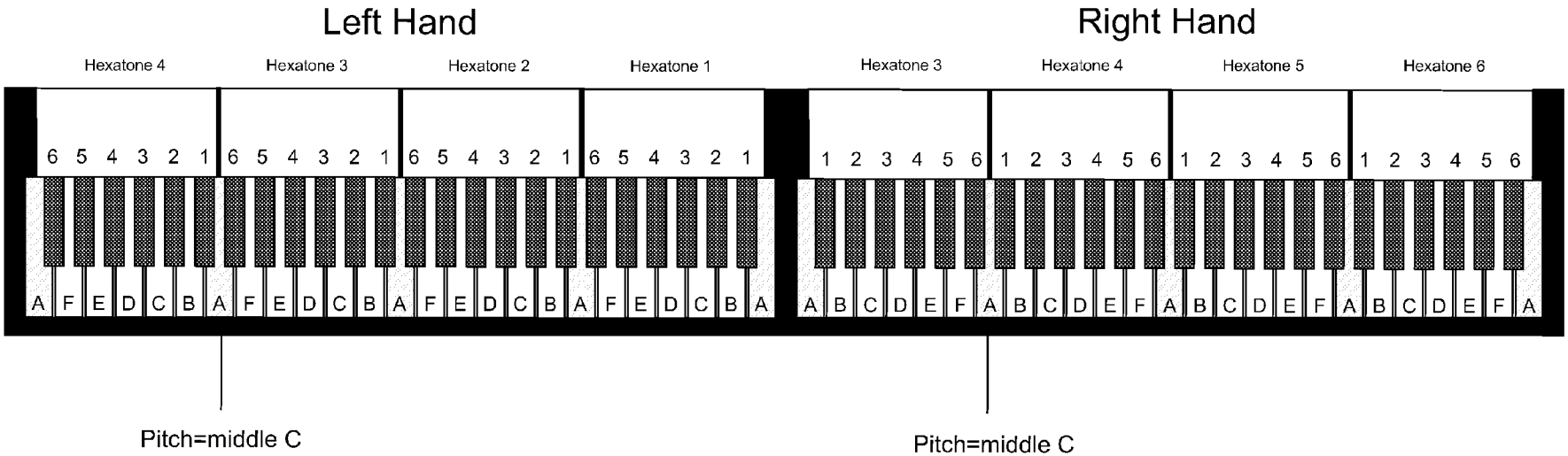
FIG. 4 is a plan view illustrating two manuals on the same keyboard that actuate a mechanism per key as described further herein.

One possible staff configuration for this notation system would be to construct a standard horizontal staff with the spaces representing one character set and the lines representing the other character set (see FIG. 2). Another possible staff configuration for this notation system would be to construct a vertical staff. One side of the vertical staff will correspond to the same side on which the manual with the inverted pitch progression is located. This side of the vertical staff will also be inverted as well. FIG. 3 shows how this vertical staff would appear based on the keyboard configuration in FIG. 1. In FIG. 2 and in FIG. 3, the numbers "3" and "4" in the boxes indicate which hexatone the notes on the staff are located in. These numbers will change if the desired notes traverse into adjacent hexatones.

In application, it can be seen that the scale fingering for this system is very simple. Starting with "A", the basic scale is A-B-C-3-4-5-6 back to A. Using the key colors in FIG. 1, the basic scale progression is even simpler. With "W" as white and "B" as black, the scale is W-W-W-B-B-B-B back to white. If you want to modulate up to any white key, the pattern is still the same; 3 white keys then 4 black keys. If you start on a black key, or modulate to a black key, then the pattern is reversed: 3B's then 4 W's and back to black. The fingers used for these scales are also very easy. With the thumb as a "1" and the pinkie as a "5", the fingering starting on a white key is 1(W)-2(W)-3(W)-1-(B)-2(B)-3(B)-4(B) and back to 1(W). The fingering starting on a black key is 1(B)-2(B)-3(B)-1(W)-2(W)-3(W)-4(W) and Back to 1(B). The incredible advantage of the bisymmetrical keyboard is that the fingering for the hand with the inverted manual is exactly the same. In addition, the fingerings for the chord structures are also exactly the same for both hands.

What is claimed is:

1. A musical keyboard split into two bisymmetrical manuals, comprising:

a first manual for keyboard fingering by a first hand of a user, comprising a first plurality of keys activating a standard pitch progression increasing in pitch from left to right;

a second manual for keyboard fingering by a second hand of a user, spilt from said first manual, comprising a second plurality of keys activating a standard pitch progression increasing in pitch from right to left; wherein:

said keyboard fingering for the first hand applied to said first manual is exactly the same as said keyboard fingering for the second hand applied to said second manual.

2. The keyboard of claim 1, wherein said first hand is a right and said second hand is a left hand.

3. The keyboard of claim 1, wherein said first hand is a left and said second hand is a right hand.

4. The keyboard of claim 1, further comprising:

the keys of each manuals activating a plurality of octaves; and the keys within each said octave activating the twelve traditional tones of an octave.

5. The keyboard of claim 1, further comprising:

said keys comprising two different heights, namely, a lower height and a raised height;

for each manual, said keys alternating key-by-key, between said lower height and said raised height; wherein:

for any octave in any key, the twelve tones of said octave comprise, in key-by-key alternation, six lower height and six raised height keys.

6. The keyboard of claim 1:

said first manual comprising a first key activating a standard tone for middle-C; and said second manual also comprising a second key activating the standard tone for middle-C.

7. The keyboard of claim 6, further comprising:

said first key activating the standard tone for middle-C located at a first tonal distance from a left end of said first manual;

said second key activating the standard tone for middle-C located at a second tonal distance from a left end of said second manual; wherein:

said first tonal distance is equal to said second tonal distance.

8. The keyboard of claim 7, wherein:

said first tonal distance and said second tonal distance are each equal to one octave.

9. The keyboard of claim 5, further comprising a dual notation system assigned thereto, said dual notation system comprising:

a lower key character set comprising six characters assigned only to the lower-height set of six keys within an octave;

a raised key character set comprising six characters different from said lower key character set, assigned only to the raised-height set of six keys within an octave; wherein:

said character assignments are repeated for each different octave.

10. The keyboard and dual notation system of claim 9, further comprising sheet music therefor, said sheet music comprising:

a staff system comprising six lines and six spaces in which:

each said space represents one of the members of said lower key character set; and each said line represents one of the members of said raised key character set.

11. The keyboard and dual notation system of claim 10, said sheet music further comprising:

a base clef of said sheet music played out in reverse relative to a standard base clef, and bisymmetrical to a treble clef of said sheet music.

12. The keyboard and dual notation system of claim 9, further comprising sheet music therefor, comprising:

a staff system comprising six lines and six spaces in which:

each said space represents one of the members of said raised key character set; and each said line represents one of the members of said lower key character set.

13. The keyboard and dual notation system of claim 12, said sheet music further comprising:

a base clef of said sheet music played out in reverse relative to a standard base clef, and bisymmetrical to a treble clef of said sheet music.

14. A sheet music system, comprising:

a staff system comprising six lines and six spaces in which:

each said space represents one of the members of a lower key character set; and each said line represents one of the members of a raised key character set; wherein an associated musical keyboard split into two bisymmetrical manuals to be played using said sheet music system comprises:

a first manual for keyboard fingering by a first hand of a user, comprising a first plurality of keys activating a standard pitch progression increasing in pitch from left to right;

a second manual for keyboard fingering by a second hand of a user, spilt from said first manual, comprising a second plurality of keys activating a standard pitch progression increasing in pitch from right to left;

said keys comprising two different heights, namely, a lower height and a raised height; and for each manual, said keys alternating key-by-key, between said lower height and said raised height; wherein:

said keyboard fingering for the first hand applied to said first manual is exactly the same as said keyboard fingering for the second hand applied to said second manual;

for any octave in any key, the twelve tones of said octave comprise, in key-by-key alternation, six lower height and six raised height keys;

said lower key character set comprises six characters assigned only to the lower-height set of six keys within an octave;

said raised key character set comprises six characters different from said lower key character set, assigned only to the raised-height set of six keys within an octave; and said character assignments are repeated for each different octave.

15. The sheet music system of claim 14, said sheet music further comprising:

a base clef of said sheet music played out in reverse relative to a standard base clef, and bisymmetrical to a treble clef of said sheet music.

* * * * *